United States Patent [19]

Bogdanovic

[11] 4,179,138

[45] Dec. 18, 1979

[54] RAIL STRIP AND LOCKING DEVICE

[75] Inventor: George Bogdanovic, Lyons, Ill.

[73] Assignee: Jet Press, Inc., Berkeley, Ill.

[21] Appl. No.: 887,930

[22] Filed: Mar. 17, 1978

[51] Int. Cl.[2] ..... A47F 7/00

[52] U.S. Cl. ..... 281/15 B; 40/16.4; 40/16.6; 40/124.2; 40/124.4; 248/223.4; 248/221.4

[58] Field of Search ..... 40/10 R, 16.2, 16.4, 40/16.6, 17, 124, 124.2, 124.4, 2 G, 360; 248/221.4, 221.3, 223.4, 224.1, 224.2, 314; 211/49 R, 50, 55; 281/15 B

[56] References Cited

U.S. PATENT DOCUMENTS

| | | | |
|---|---|---|---|
| 1,308,586 | 7/1919 | Hayes | 40/16.4 X |
| 1,757,964 | 5/1930 | Hurst | 40/16.6 |
| 2,882,625 | 4/1959 | Hopp | 40/16.2 |
| 3,102,739 | 9/1963 | Larson | 281/15 B |
| 3,239,182 | 3/1966 | Blanz | 248/223.4 X |
| 3,290,809 | 12/1966 | King | 40/16.4 X |
| 3,313,053 | 4/1967 | Vogeli, Sr. | 40/16.4 |
| 3,324,585 | 6/1967 | Frederickson | 40/16.6 X |
| 3,884,410 | 5/1975 | Giesecke | 211/50 X |
| 4,094,415 | 6/1978 | Lawson | 211/94 X |

*Primary Examiner*—Robert L. Spicer, Jr.
*Attorney, Agent, or Firm*—Hill, Van Santen, Steadman, Chiara & Simpson

[57] ABSTRACT

A rail strip and locking device has a unitary sheet-form device formed with integral tabs which may be punched out and hingedly folded back upon a correspondingly sized stationary tab, thereby to form a reinforced double thickness or triple thickness coupling for insertion into a price rail. Removable items such as pads of coupons or containers of loose cards may be hung from the locking device engaging the rail.

23 Claims, 18 Drawing Figures

RAIL STRIP AND LOCKING DEVICE

BACKGROUND OF THE INVENTION

1. Field of the Invention

This invention relates to hanger devices which are inserted into the grocery rails on shelves in supermarkets. The hanger device or rail strip provides a support upon which tear-off coupons may be mounted or supports a pocket in which individual hand-out cards or advertisements may be placed for later removal by store customers.

2. The Prior Art

It is well known in the prior art to use various types of hangers which interconnect with the grocery or freezer rails mounted on the front of supermarket shelves or freezers from which coupons or other items to be dispensed may be hung. One form of a prior art hanger is a plastic arrow, which locks into the grocery rail and has a protruding point, upon which a stack of handouts may be mounted and removed one at a time. A second prior art hanger involves a plastic hanging mechanism which also interlocks into the grocery rail for the same purpose as the arrow. It is also known to use metal hangers or corrugated cardboard hangers which lock into the rail. Finally, it has been known to produce hangers out of an appropriate thickness stock having a single thickness tab which interlocks with the grocery rail. Some of the drawbacks of the prior art from the rails ranges include, difficulty of insertion into or removal from the rail, lack of strength to stand up under repeated pulling stress generated as customers tear off coupons or remove cards, and an appearance that is not acceptable cosmetically.

SUMMARY OF THE INVENTION

The invention is an improved rail strip and locking device for supporting advertising and promotional material such as pads of tear off coupons or individually dispensable items from the grocery or price rail or freezer of a supermarket shelf. A printed vinyl board is cut so as to provide at least one tab that may be integrally hinged and folded back on a stationary tab. The doubly thick tab unit is supported within the grooves of a standard grocery or freezer rail, and due to the straight fold, the double thickness, and the radius of curvature given to the doubly folded material by the grocery rail, provides a sturdy, inexpensive, easily removable and installable hanger. Several species of the invention are possible using the basic doubly folded tab arrangement, including affixing an envelope to the rail strip or a rectangular container. In the case of narrow items, only a single doubly folded tab is necessary having the characteristics of double thickness of material joined by a fold. For heavy items, a triply thick tab having two folds may be used.

DESCRIPTION OF THE PREFERRED EMBODIMENTS

Figure 1:
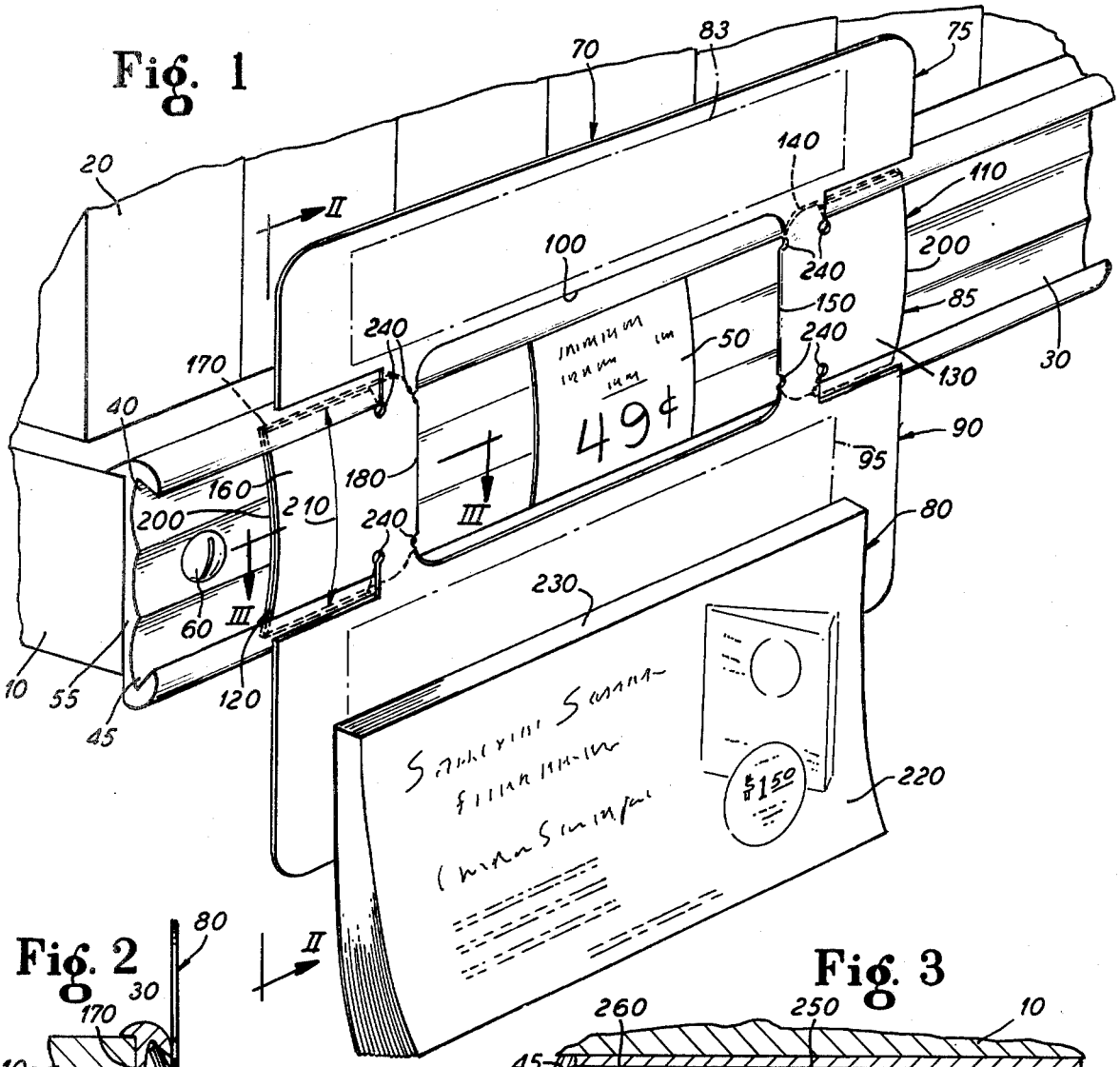
FIG. 1 is an isometric view of a hanger or strip installed in a grocery rail supporting a pad of tear-off coupons.

While the principles of the present invention find a particular utility in a hanger or strip for use with the rail on a supermarket shelf or freezer, it will be understood that the hanger arrangement of the present invention may be utilized in other combinations. By way of exemplary disclosure of the best mode of practicing the invention there is shown generally in FIG. 1 one species of the present invention hanging from the grocery rail of a supermarket shelf. A shelf 10 on which are placed items 20 for sale has a grocery rail 30 which is of a standard and known variety. The grocery rail 30 has a top slot or groove 40 and a bottom slot or groove 45 whose usual purpose is to retain a price tag 50. The spacing between the grooves 40, 45 is a standard, known distance. The price tag 50 may be inserted at the end 55 of the grocery rail 30 and slid to any desired position. The grocery rail 30 is conventionally held to the shelf 10 by a screw 60. One species of the present invention is shown in FIG. 1 as a holder or hanger 70 for a pad 80 of tear-off coupons. The pad 80 may be affixed to the hanger or strip 70 by any conventional means such as staples or glue. Vinyl has been found to be a very suitable material for constructing the hanger 70. The vinyl is very amenable to off-set printing which is especially important in that the hanger 70 must be inexpensive as well as an attractive and eye catching item, else it will not be accepted for use in the supermarket environment. The hanger 70 has a top portion 75 which has in it a region 83 wherein ad copy might be printed. The ad copy may have something to do with the items on the pad 80 or in fact could be related to a completely different subject. The hanger 70 has a central region 85 and a lower region 90. The lower region 90 also might have a region 95 suitable for printing additional ad copy as is the case with the region 83. The region 85 has a middle section 100 which has been cut out. The cut-out section 100 allows the hanger 70 to be used easily in conjunction with price tags 50 which are already installed on the rail 30. In the supermarket environment it is very important that the rail strips such as the hanger 70 which are mounted on the grocery rail 30 not obstruct pre-existing price tags or any other items which have been mounted on the rail.

The central region 85 also has a pair of tab structures 110 and 120 which are an important part of the present invention. The tab structure 110 has a region or tab 130 with an adjacent region or tab 140 disposed laterally behind it. The regions 130 and 140 are each single thickness tabs. The top region 130 is connected to the adjacent region 140 by a fold 150. The fold 150 is important as it makes the hanger 70 very rigid when under stress. The tab structure 120 has a corresponding region or tab 160, a corresponding adjacent region or tab 170 and a corresponding fold 180. It is the action of the two tab structures 110, 120 which support the hanger 70 from the rail 30. The front tab section 130 and the rear tab section 140 of the tab structure 110 both lock behind the upper slot 40 and the lower slot 45 of the rail 30. Similarly, the upper tab 160 and the rear tab 170 of the tab structure 120 lock behind the upper groove 40 and the lower groove 45 of the rail 30. The two interlocking tab structures 110, 120 provide a wobble free and strong support for the hanger 70. Further, because the hanger 70 is composed of a printed vinyl, it is very inexpensive and because of the use of offset printing is a very attractive looking device. It should be noted that the tab structures 110 and 120 each have a curvature 200 due to the fact that the spacing between the grooves 40 and 45 of the rail 30 is slightly less than the height 210 of any of the tabs 130, 140, 160 and 170. The folds 150 and 180 are straight however. The strength of the hanger 70 is due to the fact that there is a curved double thickness associated with each of the tab structures 110 and 120 in that with respect to tab structure 110 both the front tab 130 and the rear tab 140 interlock with the rail 30. Further, with respect to the tab structure 120, both the front tab 160 and the rear tab 170 also interlock with the rail 30. Additionally, the two folds 150 and 180 being straight contribute substantially to the rigidity and resist strain on the two tab structures 110 and 120. With the tab structures 110 and 120, the hanger 70 may be readily slid along the rack 30, or installed or removed. Further, installation or removal may be effected without any tools whatsoever and by relatively unskilled personnel. As can be seen from the structure of the hanger 70, in particular with reference to the pad 80, the strength of the tabs 110 and 120 is necessary when one considers the removal of a page 220 off of the pad 80 by tearing it along the adhesive line 230.

It should be noted that the tab structures 110 and 120 have therein holes 240 at the point where the tabs 140 and 170 join the folds 150 and 180 and also where the tabs 130 and 160 rejoin the central region 85 of the hanger 70. The purpose of the holes 240 is to minimize or avoid any tearing in the vinyl material due to the stresses and strains placed on the hanger 70 by removal of the sheets 220 from the pad 80.

Figure 2:
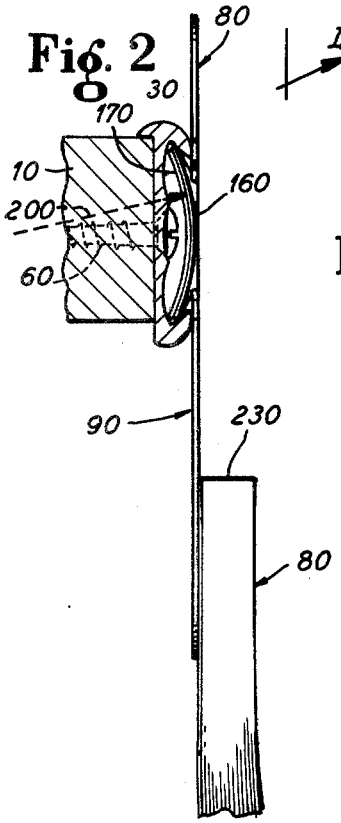
FIG. 2 is an elevated sectional view of the structure of the tabs with respect to the hanger taken along line II—II.

FIG. 2, a sectional view, discloses further the structure of tabs 160 and 170 in the region 85 of the hanger 70. The upper region 80 which sits in front of the rail 30 as well as the lower region 90 to which the pad 80 is affixed are also indicated. FIG. 2 also shows clearly that both tabs 160 and 170 exhibit the radius of curvature 200.

Figure 3:
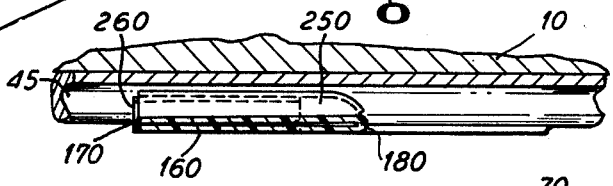
FIG. 3 is an elevated section of the lateral structure of the tabs with respect to the supporting rail taken along line III—III.

FIG. 3 shows the lateral relationship between the front tab 160, and rear tab 170 and the fold 180. Also, shown is a portion 250 of the rear of the tab 170 and a portion 260 of the tab 160 which because of the curvature 200 in the tab structure 120 are indicated as being folded behind the tab 160 and the tab 170.

Figure 4:
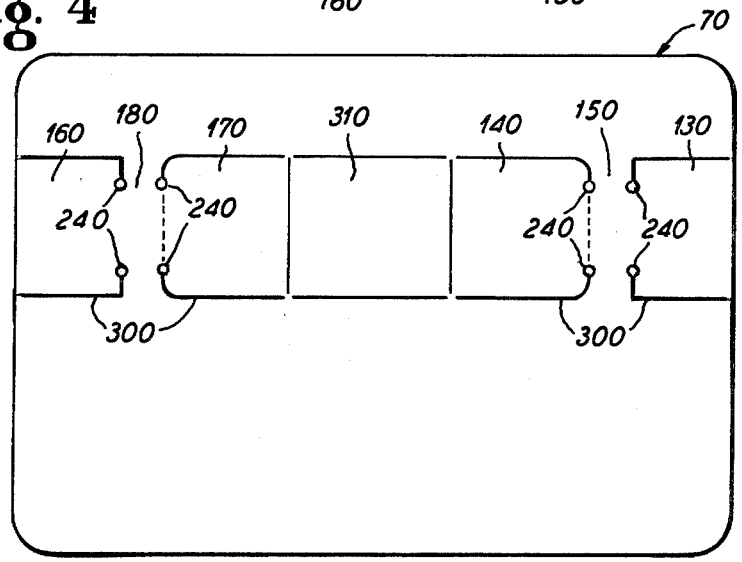
FIG. 4 is a front view of the hanger before being mounted on the grocery rail with the tabs shown in a flat unfolded position.

FIG. 4 is the hanger 70 before it has been assembled to be hung on the rack 30 and without the pad 80. The tabs 130 and 160 are shown as well as the tabs 140 and 170. The tabs 140 and 170 are shown before they have been folded behind the tabs 130 and 160 but after the strain relief holes 240 and the outlines 300 of each of the tabs has been cut. A middle area 310 is indicated which at the time when the hanger 70 is mounted on the rack 30 is removed by simply pressing to the rear of the hanger 70. Once the area of vinyl material 310 has been removed, the tabs 140 and 170 may be folded producing the folds 150 and 180 and the hanger is ready for installation.

Figure 5:
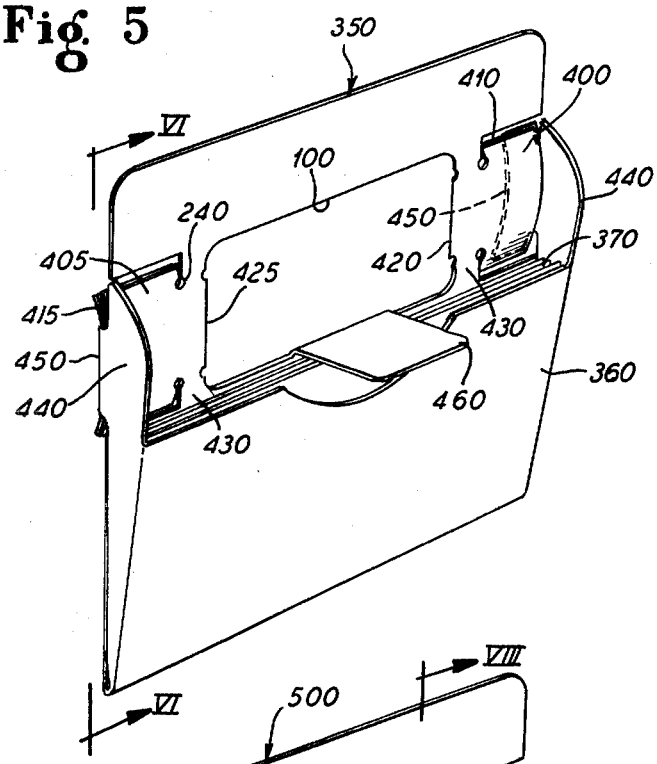
FIG. 5 is an isometric view of the hanger supporting an envelope containing individually removable cards.

FIG. 5 is a variation on the hanger or rail strip 70 of FIG. 1. In FIG. 5 a hanger or rail strip 350 having the same general structure as the hanger 70 of FIG. 1 supports an envelope 360 containing therein removable cards 370. The hanger 350 displays the same tab structure as does the hanger 70. Front tabs 400 and 405 act in unison respectively with adjacent tabs 410 and 415 which are joined respectively by a pair of folds 420 and 425 providing the necessary strength and rigidity to the hanger 350. The envelope 360 is attached to the hanger 350 by a pair of flaps 430 and is closed by a pair of side flaps 440 which have a set of restraining tabs 450 which are folded behind the rear tabs 410 and 415, respectively.

Figure 6:
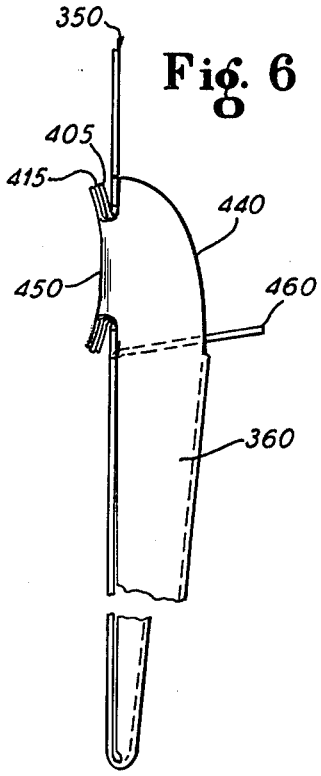
FIG. 6 is an elevated end view of the hanger supporting the envelope.

FIG. 6, an end view of the hanger 350 of FIG. 5, displays the side flap 440 with the tab 450 behind the tab 415 which in turn resides behind the tab 405. A flap 460 serves to hinder the removal of more than one of the cards 370 at any given time.

Figure 7:
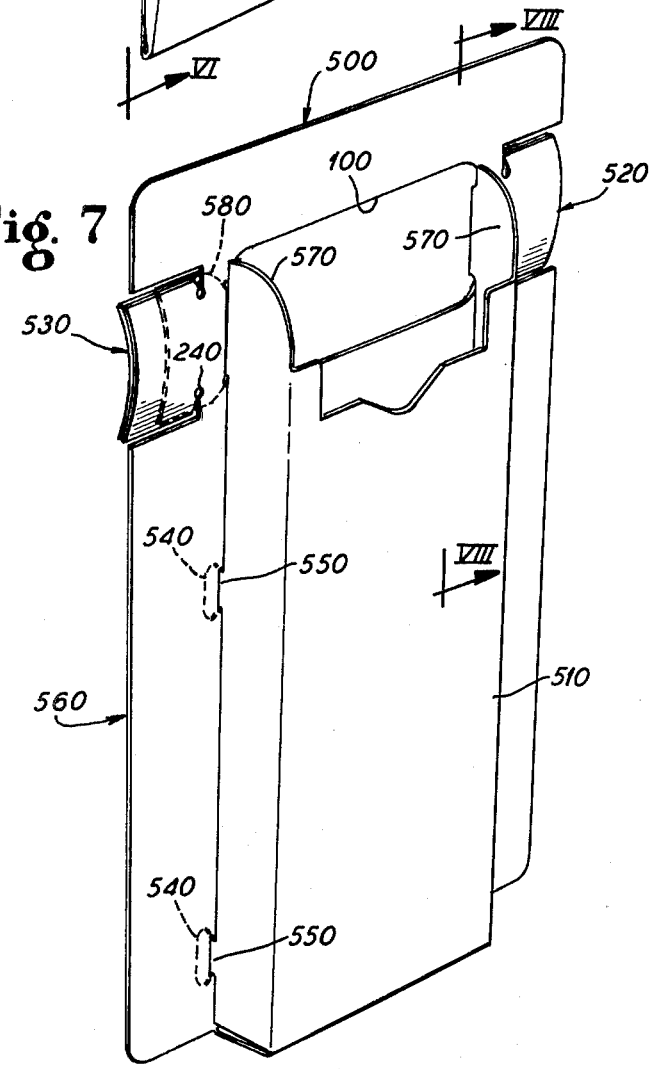
FIG. 7 is an isometric view of a hanger supporting a rectangular container affixed to the hanger by insertable tabs.

FIG. 7 is another variation of the basic hanger or rail strip 70 of FIG. 1 wherein a hanger 500 has been coupled with a rectangular box 510 which in turn is suitable for storing or holding larger items which are to be dispensed one at a time. The hanger 500 in turn has a set of tab structures 520 and 530 corresponding to the tab structures 110 and 120 of the hanger 70 of FIG. 1. The dispensing box 510 is affixed to the hanger 500 by a set of tabs 540 which pass through a corresponding set of slots 550 in the lower region 560 of the hanger 500. A set of two ears 570 on the upper portion of the box 510 is held in position with respect to the hanger 500 by a flap 580 associated with each of the ears 570 which is folded behind the tab structures 520 and 530.

Figure 8:
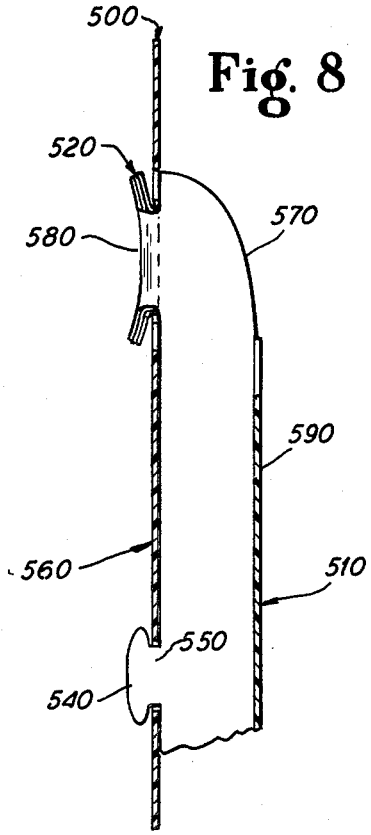
FIG. 8 is an elevated section of the strip with the rectangular container affixed to the hanger by insertable tabs taken along line VIII—VIII.

FIG. 8 is a section wherein an edge 590 of the box 510 is shown with the ear 570 and its respective flap 580 folded behind the tab structure 520. Further, the tab 540 is shown holding the box 510 against the lower portion 560 of the hanger 500 by passing through the slot 550.

Figure 9:
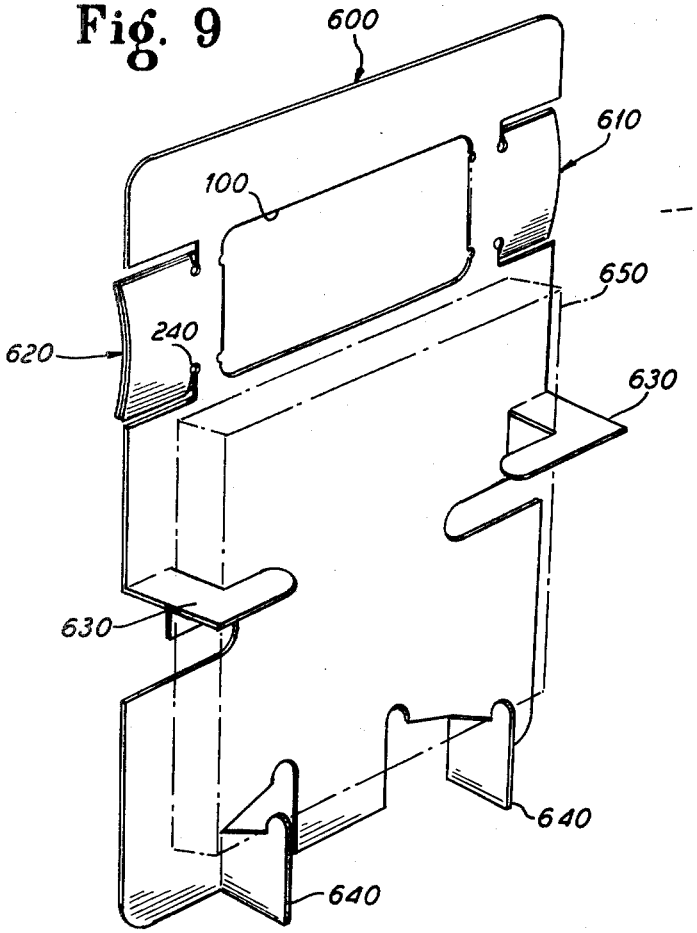
FIG. 9 is an isometric view of the hanger supporting a container by means of horizontal and vertical tabs.

FIG. 9 is yet another variation on the basic hanger or rail strip 70 of FIG. 1. A hanger 600 has a set of tab structures 610 and 620 which function precisely and are constructed in the same way as the tab structures 110 and 120 of FIG. 1. A set of brackets 630 provide horizontal support and a set of brackets 640 provide vertical support to a container 650 into which items to be dispensed one at a time may be placed.

Figure 10:
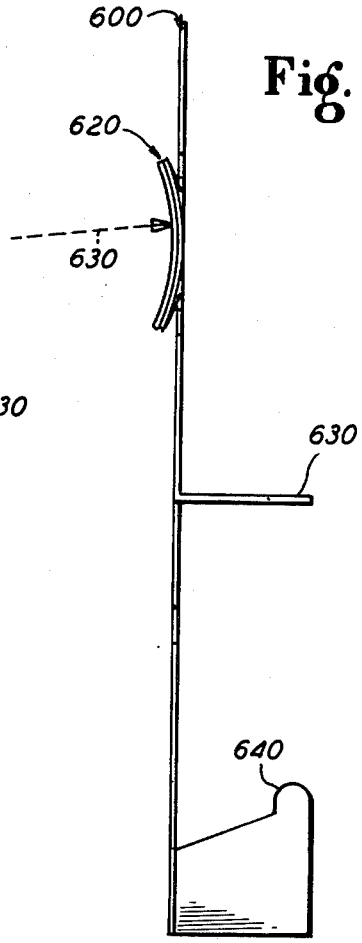
FIG. 10 is a side view of the hanger with horizontal and vertical tabs.

FIG. 10, a side view of the rail strip of FIG. 9, shows the horizontal hangers 630, the vertical hanger 640 and the tab structure 620 having a radius of curvature 630 due to the tab 620 having been installed in grooves corresponding to the grooves 40 and 45 of the rail 30.

Figure 11:
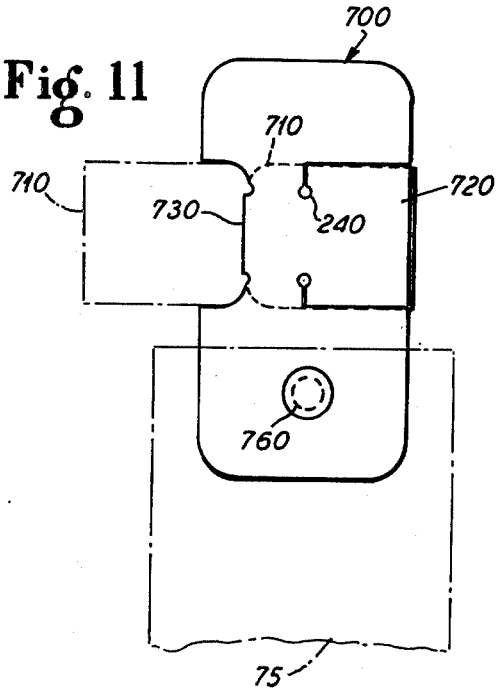
FIG. 11 is a head front of a hanger having one double folded tab for supporting small items.

FIG. 11 is a variation of the basic hanger or rail strip 70 of FIG. 1 wherein a hanger 700 is formed with a single tab structure by folding a tab 710 behind a tab 720 thereby creating a fold 730 which in conjunction with the double thickness of the tabs 720 and 710 will support the hanger 700 upon which can be hung tear-off items 750 by means of a rivet or other conventional device 760. Staples or glue could also be used. In this case, since a single tab structure has been formed by the tabs 710 and 720, the hanger 700 will occupy a very narrow portion of the rail on which it is mounted.

Figure 12:
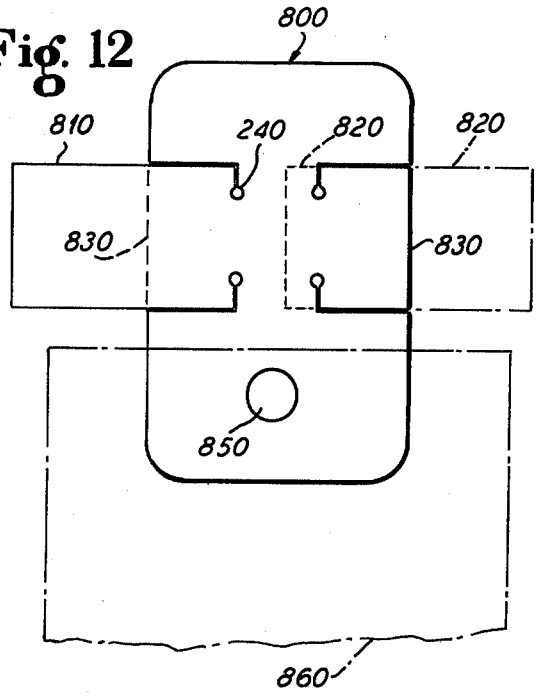
FIG. 12 is a head front of a hanger for supporting small items having a double set of folded tabs.

FIG. 12 is a variation of the hanger 700 of FIG. 11. A hanger 800 has a pair of tabs 810 and 820, each of which is folded along a line 830 to provide the double thickness tab structures. A rivet 850 can be installed on the hanger 800 to retain the tear-off items 860 until they are removed. Staples, glue or any other conventional means could be used. While narrower than the hanger of FIGS. 1–10, the hanger 800 of FIG. 12 still has a double set of tab structures thus providing more support than is found in the simple tab structure of FIG. 11.

Figure 13:
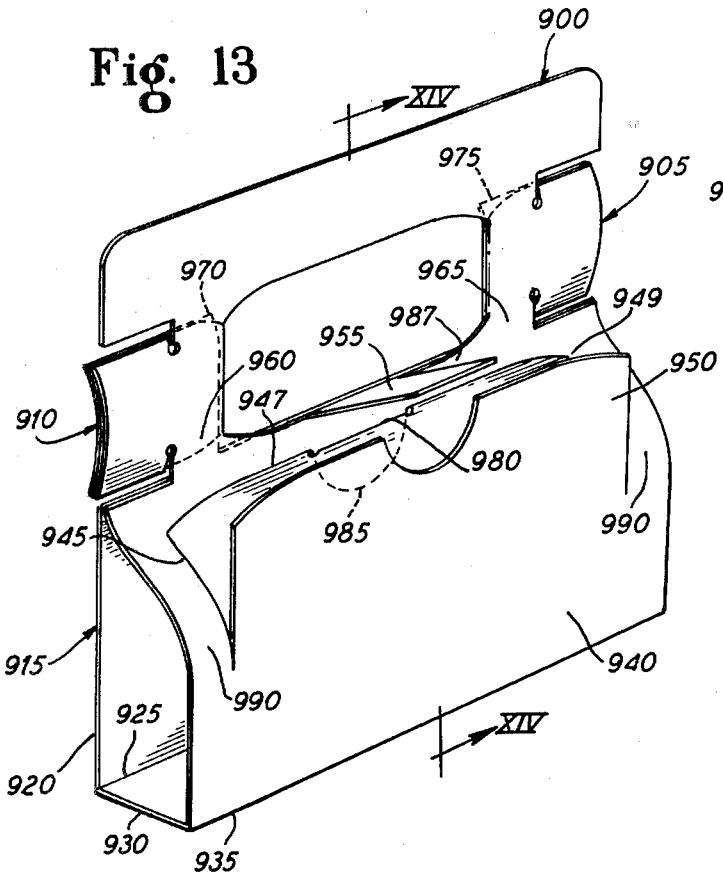
FIG. 13 is an isometric view of a hanger supporting an expanded envelope-style container for individually removable cards.

FIG. 13 is another variation of the hanger of FIG. 1 supporting an expanded envelope structure. A rail strip or hanger 900 has a pair of tab structures 905 and 910, respectively, constructed as the pair of tab structures 110 and 120, of FIG. 1. A lower region 915 of the hanger 900 is an expanded envelope structure having a rear side 920, a first bend 925, a base 930, a second bend 935 and a front member 940. The front member 940 has a rectangular shaped cut consisting of three sides 945, 947 and 949 which allows a flap 950 to extend vertically thereby providing a front to the expanded envelope of the region 915. The two cuts 945 and 949 also function so as to provide sides to the expanded envelope such that material placed within the opening made by the flap 950 does not slide laterally out of the expanded envelope 915. A flap 955 is provided so as to discourage removing more than one item at a time from the expanded envelope 915. The front 940 of the expanded envelope 915 is integrally attached to the hanger 900 by means of a pair of tabs 960 and 965. The rear member 920 holds the expanded envelope 915 closed by means of a pair of tabs 970 and 975, affixed to the rear member 920, which lock into the shelf rail behind the tab structures 905 and 910. The rear member 920 also has a slot 980 into which is inserted a tab 985 which is affixed to the front portion 987 of the hanger 900 for additional support.

Figure 14:
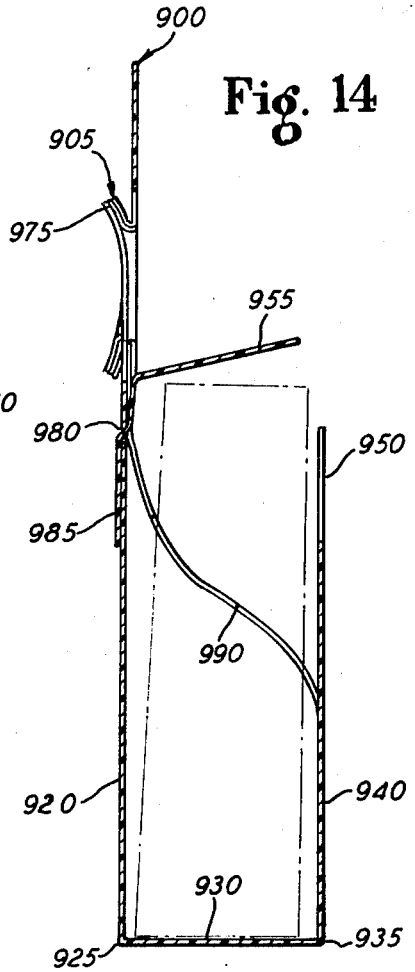
FIG. 14 is a section view taken along line XIV—XIV of the strip supporting the expanded envelope.

FIG. 14, a section taken along line XIV—XIV of FIG. 13, illustrates the relationship of the front tab 955 with the rear supporting tab 985 fitting through the slot 980. Additionally, the rear member 920 is shown having the tab 975 which is positioned behind and adjacent to the tab structure 905. The curved side pieces 990 are shown in relationship to the front panel 940 with the rectangular cut-out 950.

Figure 15:
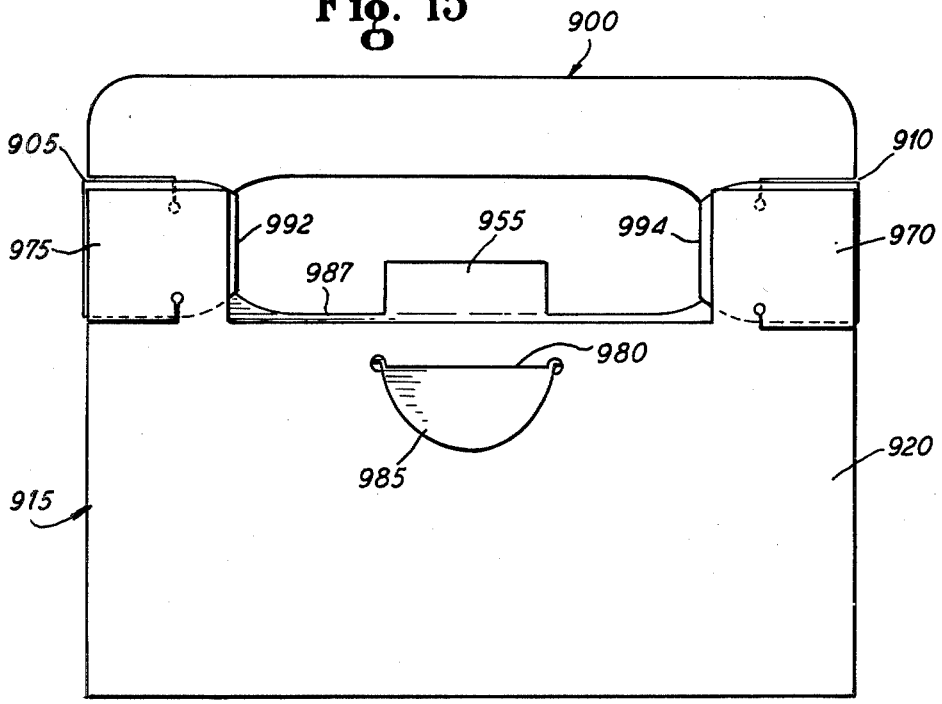
FIG. 15 is a rear view of the strip of FIG. 13.

FIG. 15 is a rear view of hanger 900 supporting the expanded envelope 915. The flap 985 is shown extending through the slot 980 of the rear panel 920. The two tabs 970 and 975 affixed to the rear panel 920 are indicated behind the two tab structures 905 and 910, respectively. The two folds 992 and 994 in the tab structures 905 and 910 respectively are indicated as well as the flap 955 which is affixed to the portion 987 of the hanger 900.

Each of the species shown in FIG. 1, FIG. 5, FIG. 7 and FIG. 9 has a central open region corresponding to the open region 100 in FIG. 1 so that as the hanger is mounted on the rail 30, the price tags or other items affixed to the rails will continue to be visible. Further, it should be noted that all the species of the disclosed invention have the stress relief holes 240 disclosed originally in FIG. 1 to prevent tearing of the vinyl as the individual items are removed from the hanger one at a time.

The various forms of the invention disclosed herein have all been described with reference to a grocery shelf rack. Similar racks are used for freezers. The only difference being the spacing between the upper and lower grooves of the rack. By adjusting the height of the tab structures described herein, the hangers described herein may be used with freezer or rails of any other desired spacing.

It should also be noted that the hanger 70 of FIG. 1, the hanger 700 of FIG. 11 or the hanger 800 of FIG. 12 may be used as rail strips without supporting any removable items simply by removing the lower portions which support the removable items. Further, they may all be used without an upper display region such as 75 in FIG. 1.

Figure 16:
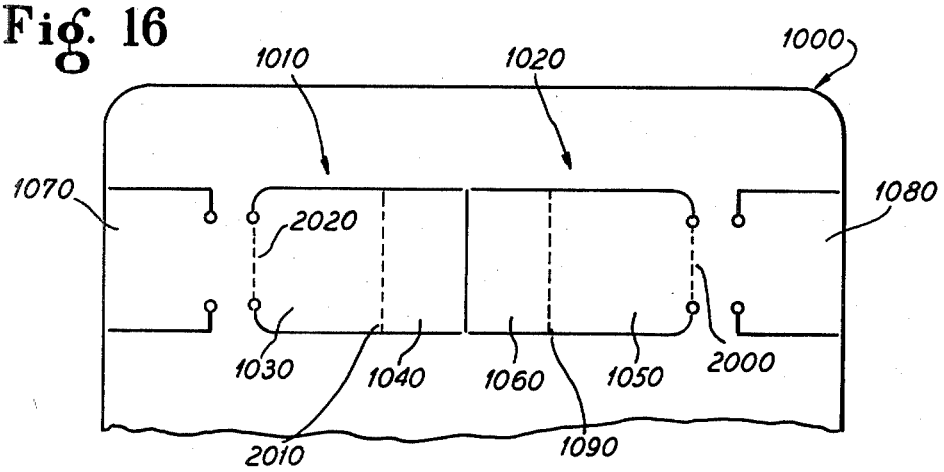
FIG. 16 is a front unfolded view of a rail strip having a triple thickness tab.
Figure 17:
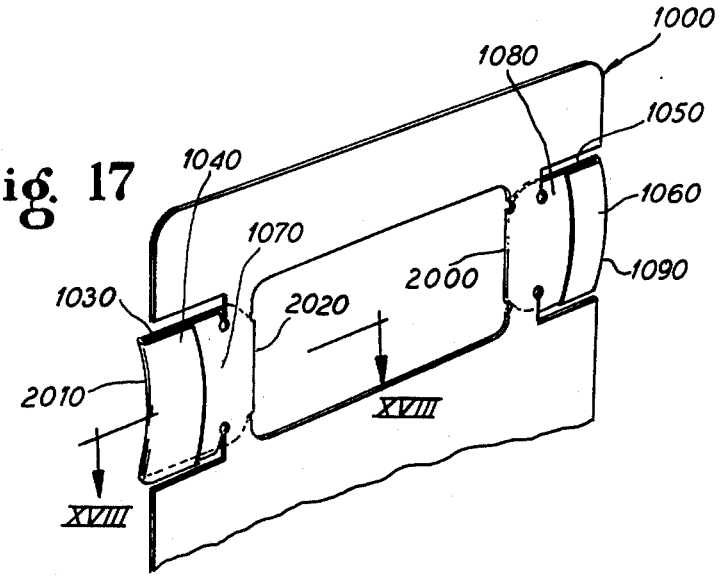
FIG. 17 is a partial, isometric view of a rail strip with a triple thickness tab.
Figure 18:
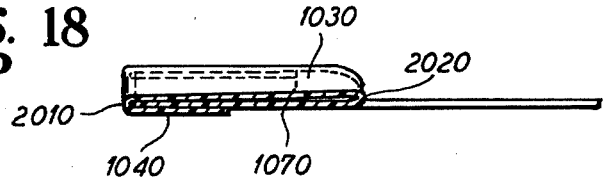
FIG. 18 is an enlarged section taken along line XVIII—XVIII of the triple thickness supporting tab.

Another species of the invention is disclosed in FIG. 16. A rail strip 1000 having a pair of tabs 1010 and 1020 is disclosed for use with particularly heavy removable indicia. The rail strip 100 has a triply thick tab structure which provides extra strength to support the extra heavy indicia. The tab structure 1010 is composed of two parts, a tab 1030 which corresponds to the basic tab 170 of FIG. 4, and a tab 1040 which is operable to provide the triply thick supporting structure. Similarly, the tab structure 1020 has a basic tab 1050 and a tab for use with the extra heavy indicia 1060. Two additional tabs 1070 and 1080 correspond to the two basic tabs 160 and 130 of FIG. 4. FIG. 7, an isometric view showing the folded tab structure achievable with the flat card of 1000 of FIG. 16 shows the basic tab 1080 adjacent to the triply thick tab structure 1060 and the basic tab 1050. The tab structure 1050 and 1060 are joined by a fold 1090. There is an additional fold 2000 which corresponds to the basic fold 150 of FIG. 1. Correspondingly, at the other end of the rail strip 1000 the basic tab 1070 is located between the folded triple strength tab 1040 and the basic tab 1030 which are joined by a fold 2010. The tab 1030 and the tab 1070 are joined by a fold 2020. FIG. 18, a section taken along the line XVIII—XVIII illustrates the detailed triply thick supporting tab structure. The basic tab 1070 is shown adjacent to the tab 1030 and adjacent to the triply thick tab 1040. The triply thick tab 1040 is joined to the basic tab 1030 by the fold 2010.

Although various modifications might be suggested by those skilled in the art, it should be understood that I wish to embody within the scope of the patent warranted hereon all such modifications as reasonably and properly come within the scope of my contribution of the art.

I claim as my invention:

1. A strip for use with a rail having a top and bottom groove comprising:

a piece of sheet stock;

said piece of sheet stock having at least a first and second tab defined thereon;

each of said first and second tabs having three connected sides separated from said piece of sheet stock;

said second tab being foldingly alignable with respect to said first tab by being folded so as to be laterally disposed with and adjacent to said first tab;

said first tab being joined to said second tab along said fold; said three sides of said first and second tabs having preselected dimensions with said first and said second tab being removably engageable with the top and bottom groove of the rail.

2. The strip according to claim 1 having further:

means for removably affixing thereto manually removable discrete articles.

3. The strip according to claim 1 wherein said preselected dimensions being selected such that said fold stays substantially straight with said first and second tabs removably engaging the top and bottom grooves of the rail.

4. The strip according to claim 1 wherein said piece of sheet stock comprises a piece of vinyl of preselected thickness.

5. The strip according to claim 2 wherein said means for removably affixing comprises a layer of glue.

6. The strip according to claim 2 wherein said means for removably affixing comprises a receptacle of selected dimensions with an open top affixed to said strip.

7. The strip according to claim 6 wherein said receptacle is affixed to said strip by horizontal and vertical tab structures integral to said strip.

8. The strip according to claim 6 wherein said receptacle is affixed to said strip by tab structures integral to said receptacle operable to engage a plurality of slots in selectively placed upon said strip.

9. The strip according to claim 6 wherein said receptacle comprises an expanded envelope having a front and rear member affixed to said strip with a bottom joining said front and rear members with side members integrally affixed to said front member.

10. The strip according to claim 2 wherein said means for removably affixing comprises a flap integral to said strip;

said flap being foldable along a predetermined line to form a pocket;

said flap having a first and second flap disposed at each end thereof and foldable so as to contact said strip and form a pocket having closed ends;

said foldable flaps each having at least one tab operable to be aligned adjacent to said first on said second tabs to lock said pocket in place.

11. The strip according to claim 2 wherein said means for manually affixing comprises:

a plurality of slots affixed upon said strip selectively spaced with respect to each other;

a second piece of sheet stock foldable along predetermined lines to form a receptacle without a back or top and having a plurality of tabs integral therewith;

said tabs of said second piece of sheet stock being operable to engage said plurality of slots of said strip so as to provide a back to said receptacle without closing off said top.

12. A hanger for use with a rack having a top and bottom retaining groove comprising; a piece of sheet stock having, a first and second region defined thereon such that each of said regions has a first and second side substantially parallel to one another intersected by a third side;

said first and second regions being spaced a selected lateral distance apart from one another;

a third and fourth region defined thereon such that each of said regions has a first and second side substantially parallel to one another intersected by a third side;

said third and fourth regions being spaced between said first and said second regions with said first and second sides of said first and second regions being substantially parallel to said first and second sides of said third and fourth regions; said third and fourth regions being further aligned with respect to said first and second regions respectively such that the open ends of said first and third and said second and fourth regions merge forming a first and second tab structure respectively composed of said merged first and third regions and said merged second and fourth regions;

said first and second tab structures being separated from said piece of sheet stock along each of said first, second and third sides of said four regions;

said third region of said first tab structure being folded so as to be adjacent to said first region;

said fourth region of said second tab structure being folded so as to be adjacent to said second region;

said first and second sides of said adjacent first and third regions of said first tab structure being insertable respectively into the top and bottom retaining grooves of the rack;

said first and second sides of said adjacent second and fourth regions of said second tab structure being removably insertable respectively into the top and bottom retaining grooves of the rack.

13. A hanger according to claim 12 having further, means for removably attaching manually removable discrete information bearing devices.

14. A hanger according to claim 12 with all four of said regions each having a centerline parallel to each of said first and second sides and parallel and coincident with the centerlines of each of said other three regions.

15. The hanger according to claim 12 with said third side of said first and second regions being substantially perpendicular to said first and second sides of said first and second regions.

16. The hanger according to claim 12 with the distance between said first and second sides of said first and second tab structures being selected so as to cause said first and second tab structures to exhibit a preselected radius of curvature when said hanger is removably inserted into the rack.

17. The hanger of claim 16 with said folds joining said first and third regions and said second and fourth regions being substantially straight.

18. A hanger for use with a rack having a top and bottom retaining groove comprising; a piece of sheet stock having, a first and second tab defined thereon such that each of said tabs has a first and second side substantially parallel to one another intersected by a third side;

said first and second tabs being spaced a selected lateral distance apart from one another;

said first tab being foldable so as to be adjacent to said second tab;

said first and second sides of said adjacent first and second tabs being removably insertable respectively into the top and bottom retaining grooves of the rack.

19. The hanger according to claim 18 having further, means for removably attaching thereto discrete, removable items.

20. In a rail strip and locking device of the type comprising a sheet-form body member made of flexible plastic material and having a pair of stationary tabs spaced apart from one another on a longitudinal axis and sized to be inserted into the price rail of a display shelf, the improvement of a punch-out section in said body member intermediate said stationary tabs and separated from each said stationary tab by an unbroken portion of said body member, integral hinge means between said punch-out section and each said unbroken portion, and reinforcing tabs formed in said punch-out section, each hingedly foldable about said hinge means back upon a corresponding stationary tab and sized to be inserted into the price rail together with a corresponding one of said stationary tabs, thereby to provide a double thickness reinforced coupling of the locking device with the price rail.

21. In a device as defined in claim 20, pad means carried on said device for selectively positioning and removing sheet material adjacent a merchandise display.

22. In a device as defined in claim 20, pouch means carried on said device for selectively positioning loose material for removal adjacent a merchandise display.

23. The strip according to claim 4, wherein the free end of said second tab may be foldingly aligned with the front of said first tab with said first tab being adjacent to said second tab and to said free end of said second tab.

* * * * *